US010124200B2

(12) United States Patent
Chen

(10) Patent No.: US 10,124,200 B2
(45) Date of Patent: Nov. 13, 2018

(54) BATTLE TRAMPOLINE GAME

(71) Applicant: Samuel Chen, Shanghai (CN)

(72) Inventor: Samuel Chen, Shanghai (CN)

( * ) Notice: Subject to any disclaimer, the term of this patent is extended or adjusted under 35 U.S.C. 154(b) by 106 days.

(21) Appl. No.: 15/352,315

(22) Filed: Nov. 15, 2016

(65) Prior Publication Data

US 2018/0133530 A1 May 17, 2018

(51) Int. Cl.
*A63B 5/11* (2006.01)
*A63B 71/06* (2006.01)

(52) U.S. Cl.
CPC ..... *A63B 5/11* (2013.01); *A63B 2071/0625* (2013.01); *A63B 2220/805* (2013.01); *A63B 2220/833* (2013.01)

(58) Field of Classification Search
CPC .... A63B 5/11; A63B 5/12; A63B 5/16; F41A 33/02; A52B 5/11
See application file for complete search history.

(56) References Cited

U.S. PATENT DOCUMENTS 3,227,449 A 1/1966 Schwab
3,294,401 A 12/1966 Nicholas et al.
3,312,471 A * 4/1967 Nissen ..... A63B 5/11 182/139
3,501,141 A 3/1970 Nissen
3,898,747 A 8/1975 Marshall
4,695,058 A * 9/1987 Carter, III ..... F41J 5/02 434/16
5,833,557 A * 11/1998 Cole ..... A63B 5/11 473/472
5,904,621 A 5/1999 Small
6,302,796 B1 * 10/2001 Lebensfeld ..... A63F 9/0291 446/175
6,814,667 B2 11/2004 Jeffway
7,111,846 B1 9/2006 Breslow et al.
7,481,740 B2 1/2009 Colling
7,611,427 B1 11/2009 Cline
7,632,187 B1 12/2009 Farley et al.
(Continued)

FOREIGN PATENT DOCUMENTS

FR 3040633 A1 * 3/2017 ..... G08C 17/02

OTHER PUBLICATIONS http://www.inflatable2000.com/xtreme-lazer-35-interactive-inflatable.html "Xtreme Laser Tag" Mar. 9, 2014.*
(Continued)

*Primary Examiner* — Nyca T Nguyen
(74) *Attorney, Agent, or Firm* — Clement Cheng

(57) ABSTRACT

A trampoline game has a trampoline with a trampoline frame and a trampoline bed. The trampoline bed is connected to the trampoline frame by a plurality of springs. A gun has an infrared emitter emitting an infrared signal. A target has one or more infrared receivers capable of receiving a signal from the infrared emitter of the gun. A second gun also has an infrared emitter emitting an infrared signal, and the target is capable of receiving an infrared signal from the second gun. A bounce sensor can be used for sensing user bounces. The bounce sensor outputs data which could be sent to a microprocessor. Defined game parameters may be stored in memory programmed into a microprocessor that receives data.

18 Claims, 4 Drawing Sheets

(56) References Cited

U.S. PATENT DOCUMENTS

| | | | | |
|---|---|---|---|---|
| 7,762,927 | B1 * | 7/2010 | Gordon | A63B 5/11 482/27 |
| 8,430,795 | B2 | 4/2013 | Publicover et al. | |
| 2005/0043122 | A1 | 2/2005 | Publicover et al. | |
| 2010/0190608 | A1 | 7/2010 | Publicover et al. | |
| 2011/0136597 | A1 * | 6/2011 | Gordon | A63B 5/11 473/478 |
| 2012/0077642 | A1 * | 3/2012 | Chen | A63B 5/11 482/27 |
| 2013/0184085 | A1 * | 7/2013 | Clark | A63F 9/0291 463/56 |
| 2014/0038678 | A1 * | 2/2014 | Chen | A63B 69/0053 463/7 |
| 2016/0377367 | A1 * | 12/2016 | Davis, III | F41A 33/02 463/52 |

OTHER PUBLICATIONS http://www.inflatable2000.com/xtreme-lazer-35-interactive-inflatable.html "Xtreme Laser Tag1" Mar. 9, 2014.*

* cited by examiner

BATTLE TRAMPOLINE GAME

FIELD OF THE INVENTION

The present invention is in the field of multiplayer trampoline games.

DISCUSSION OF RELATED ART

The same inventor Samuel Chen invented a mostly single player trampoline game with targets connected to the trampoline frame. The single player trampoline game has had good success, and can be improved by introducing a multiplayer trampoline game. U.S. Pat. No. 8,585,558 issued Nov. 19, 2013 entitled Trampoline Game, by same inventor Samuel Chen provides for a single player infrared beam trampoline game, the disclosure of which is incorporated herein by reference.

A variety of trampoline games have been played on trampolines, such as basketball. Publicover describes a trampoline game accessory entitled Trampoline Game Accessory in United States publication 20050043122 published Feb. 24, 2005, the disclosure of which is incorporated herein by reference. The trampoline game includes a variety of electronic buttons located above a trampoline bed. Inventor Publicover in United States publication 20100190608 published Jul. 29, 2000, describes a trampoline game entitled Trampoline Game System With Additional Optional Accessories that include variations of tag, hopscotch, volleyball, basketball and other modifications of traditional games which may include scoring a goal with a ball.

Inventor Coiling in U.S. Pat. No. 7,481,740 issued Jan. 27, 2009, includes a soccer goal fitted on a portion of a trampoline enclosure net, entitled Soccer Goal Fitted On Portion Of Trampoline Enclosure Net, the disclosure of which is incorporated herein by reference.

Other devices such as Chen in U.S. Pat. No. 6,918,846 entitled Inflatable Basketball Structure provides for an inflatable basketball structure which can also be used for enclosing a trampoline structure. Inventors Nissen and Conover described a trampoline game with an aerial projectile apparatus in U.S. Pat. No. 3,501,141A, entitled Trampoline and Backstops, on Mar. 3, 1917.

A variety of different electronic target games entitled Electronic Target Games are described by Nicholas and Sarnow in U.S. Pat. No. 3,294,401, filed on Oct. 2, 1962, which provide electronic amusement devices that utilize a unique light-activated target.

Two-player trampoline games involving electronic amusement devices, such as an infrared emitting gun, have been described by Chen in U.S. Pat. No. 8,585,558 issued Nov. 19, 2013, entitled Trampoline Game, the disclosure of which is incorporated herein by reference. Marshall describes a simulated weapon firing system using lasers in U.S. Pat. No. 3,898,747, filed on Jun. 24, 1974, entitled Laser System for Weapon Fire Simulation, the disclosure of which is incorporated herein by reference. A simulated weapon firing system is also described by Carter, I I I et. al. in U.S. Pat. No. 4,695,058 on Sep. 22, 1987 entitled Simulated Shooting Game with Continuous Transmission of Target Identification Signals, the disclosure of which is incorporated herein by reference. The device and method for an electronic tag game has also been described by Farley et. al. in U.S. Pat. No. 7,632,187 issued Dec. 15, 2009, entitled Device and Method for an Electronic Tag Game, in which a device combining a gun and target for facilitating a game of tag using infrared light communications between two or more players is provided, the disclosure of which is incorporated herein by reference. A hand-held electronic toy gun and target apparatus facilitating a game of tag is described in Electronic Game with Infrared Emitter and Sensor by Small et. al. in U.S. Pat. No. 5,904,621 A on May 18, 1999, the disclosure of which is incorporated herein by reference.

Trampoline barriers have been discussed by Publicover et al in U.S. Pat. No. 8,430,795 issued Apr. 30, 2013, entitled Trampoline or Like with Enclosure, the disclosure of which is incorporated herein by reference. Of particular relevance is the woven netting, strong fabric, or other forms of plastic mesh material that could be used for the barrier. Inventor Schwab described a draped-web target device similar to a curtain in U.S. Pat. No. 3,227,449 issued May 13, 1963, entitled Draped-web Target Device, the disclosure of which is incorporated herein by reference.

The infrared-absorbing materials are described in Subramanian et. al. in WO2012103578 on Aug. 9, 2012 entitled Transparent Infrared-Absorbing Materials, the disclosure of which is incorporated herein by reference. The infrared ray-absorbing fabric may be transparent or translucent and created by immersing synthetic fibers in a treating solution containing an infrared ray-absorbing substance described by Fujii et al in JP2009203596A on Jan. 27, 2009, entitled Infrared Ray-Absorbing Fabric and Method for Producing the Same, the disclosure of which is incorporated herein by reference.

In player versus player beam tag, players wear special equipment having three pieces: a shooting or tagging device (e.g. a gun), a receiving sensor that is worn over the player's clothing and records another player's tag of him, and a computer pack including a battery pack and micro-processor that tallies the hits and wounds. Each weapon may be coupled to the damage inflicted by that weapon for scorekeeping purposes.

Trampoline games have used balls as game projectiles. For example, Cline in U.S. Pat. No. 7,611,427 on Nov. 3, 2009, entitled a Method, System, and Apparatus for Providing Multi-Player Competitive Recreation, described trampoline game using balls. A game partition has opposing side edges, a top edge, and a bottom edge. Transparent or translucent partition material spans the area defined by these edges and includes at least one aperture sized to allow a game ball to pass through. The game partition also includes numerous apertures of various shapes and sizes. The game partition may be utilized in conjunction with a trampoline or inflatable jumping device to provide teams of players to attempt to tag opposing players with balls thrown through the apertures in the game partition while maneuvering on the jumping surface. According to one implementation, points are scored and accumulated according to point values assigned to each aperture when a ball is thrown through an aperture and tags an opposing player. The Cline invention combined the hand eye coordination of projectile balls with the kinesthetic motion of trampoline jumping.

SUMMARY OF THE INVENTION

A trampoline game has a trampoline with a trampoline frame and a trampoline bed. The trampoline bed is connected to the trampoline frame by a plurality of springs. A game gun has an infrared emitter emitting an infrared signal. A target has one or more infrared receivers capable of receiving a signal from the infrared emitter of the game gun.

A second gun also has an infrared emitter emitting an infrared signal, and the target is capable of receiving an infrared signal from the second gun. A bounce sensor can be used for sensing user bounces. The bounce sensor outputs data which could be sent to a microprocessor. Defined game parameters may be stored in memory programmed into a microprocessor that receives data. A boss target game parameter and underling target game parameters may also be included so that the boss target has greater hit points than underling targets making the boss more challenging.

A game level game parameter can be defined as a round requiring a complete deactivation of every target. Player attribute game parameters may include a gun cooldown time defined as a set delay time that the gun requires before a successive shot is initiated. Player attribute game parameters could also include a gun ammunition capacity defined as the number of shots that the gun stores such that when the gun ammunition reaches zero the gun can no longer hit targets.

Player attribute game parameters may also include player hit points defined as a certain number of hit points required to eliminate the player. Player attribute game parameters could also include a charge per bounce defined as the number of bounces required to load a shot of ammunition to allow the gun to fire a single shot. The bounce sensor senses the bounces and sends bounce signals to the microprocessor. The microprocessor increments the shot of ammunition. A hit point visual indicator can be located on the target implemented by LED lighting.

Additionally, the bounce sensor could be used for cycling the active target, or cycling different locations of vulnerable areas on various active targets. The bounce sensor could also be used for cycling or changing other game parameters. The bounce sensor could be used for toggling different sound or visual effects related to the game as well as for toggling player attributes or target attributes.

Figure 1:
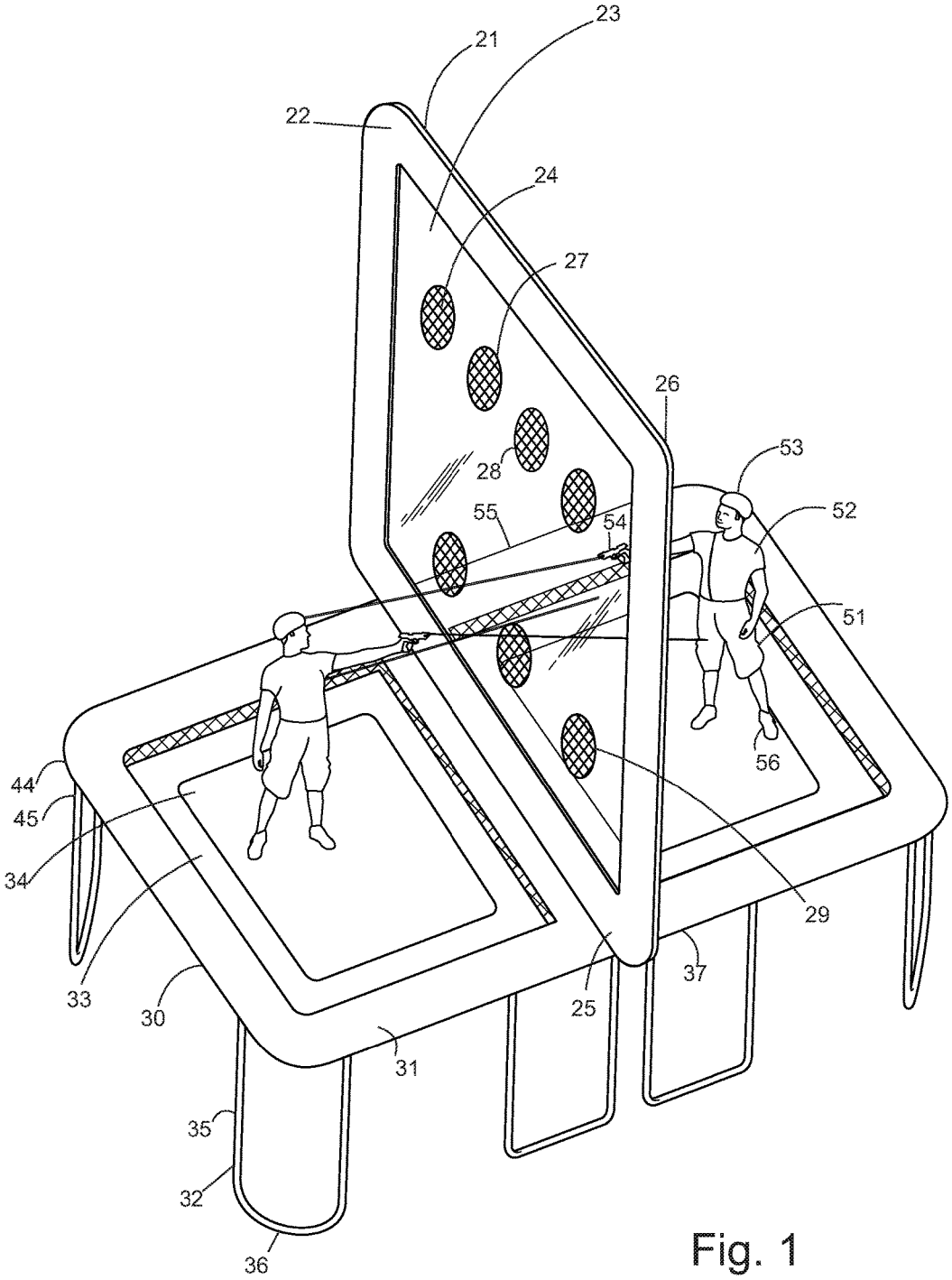
FIG. 1 is a diagram of the multiplayer trampoline game.

The following callout list of elements can be a useful guide in referencing the elements of the drawings.

21 Screen Frame
22 Screen Border
23 Non-Permeable Portion
24 Permeable Portion
25 Screen Base Connection
26 Upper Screen Connection
27 Screen Opening
28 Permeable Portion Interface
29 Screen Opening Edge
30 Trampoline Frame
31 Trampoline Pad
32 Trampoline Leg
33 Bed Border
34 Bed Play Area
35 Leg Vertical Portion
36 Leg Base
37 Horizontal Frame Section
40 Enclosure
41 Enclosure Pole
42 Enclosure Upper Ring
43 Enclosure Netting
44 Pole Connector
45 Pole Connection Area
50 Player
51 Pants
52 Shirt
53 Head Protection
54 Game Gun
55 Beam
56 Socks
57 Top Row
58 Bottom Row
59 Mesh Openings
101 First Trampoline
102 Second Trampoline
103 CPU
104 Beam Sensor
105 Beam Emitter Element
106 Wireless Connection
145 Plug
140 Bounce Sensor
148 Control Housing
170 Game Lights
220 Power Supply
240 Game Speakers

DETAILED DESCRIPTION OF THE PREFERRED EMBODIMENT

The present invention has a pair of playing areas, namely the bed play areas 32 where users can jump on the trampolines and battle each other in an infrared beam game of tag. The bed play areas 32 are on trampolines. A first trampoline 101 faces a second trampoline 102. The pair of trampolines are segmented by a screen 20. The screen 20 has a screen frame 21. The screen frame is a rigid frame that can be made of tubular steel. The screen frame has a screen border that can be a fabric retaining member that is flexible and elastic for maintaining a flat surface.

The assembly of the trampoline begins with the trampoline frame 30. The trampoline frame 30 generally includes a trampoline pad 31. The trampoline leg 32 supports the trampoline and has a leg base 36 that is generally horizontal in a U-shaped configuration. The trampoline leg 32 has a leg vertical portion 35 which attaches to a horizontal frame section 37 of the trampoline. The horizontal frame section 37 is formed as a square or pentagon or other regular polygon to provide a horizontal frame in a loop that allows the bed to stretch across the horizontal frame section 37. The horizontal frame section 37 generally has springs that can be coil or helical springs for connecting the trampoline bed to the horizontal frame section 37. The trampoline bed is thus drawn tight to allow a user to bound. Preferably, the bed play area 34 is of a contrasting color with the bed border 33.

After assembly of the trampoline frame, the screen 20 can be attached to the trampolines. Each trampoline has a horizontal frame section 37 in a loop to isolate the motion of the users. The screen 20 can be mounted to the ground, or can be mounted to the horizontal frame sections 37 of the first trampoline 101 and the second trampoline 102. The screen 20 has a screen base connection 25 which can be formed as brackets for securing to the horizontal frame sections 37.

Figure 2:
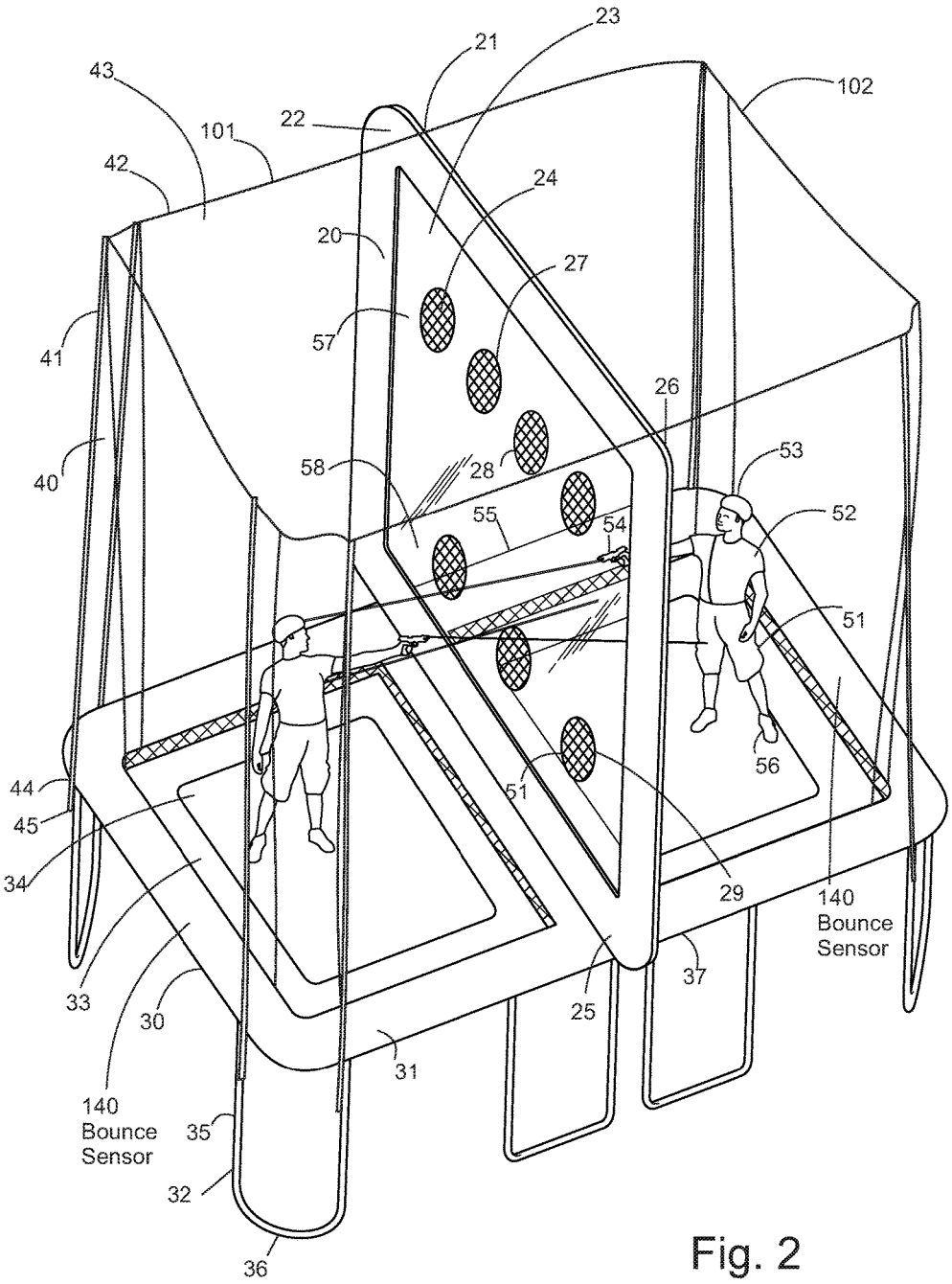
FIG. 2 is a diagram of the multiplayer trampoline game with an enclosure.
Figure 3:
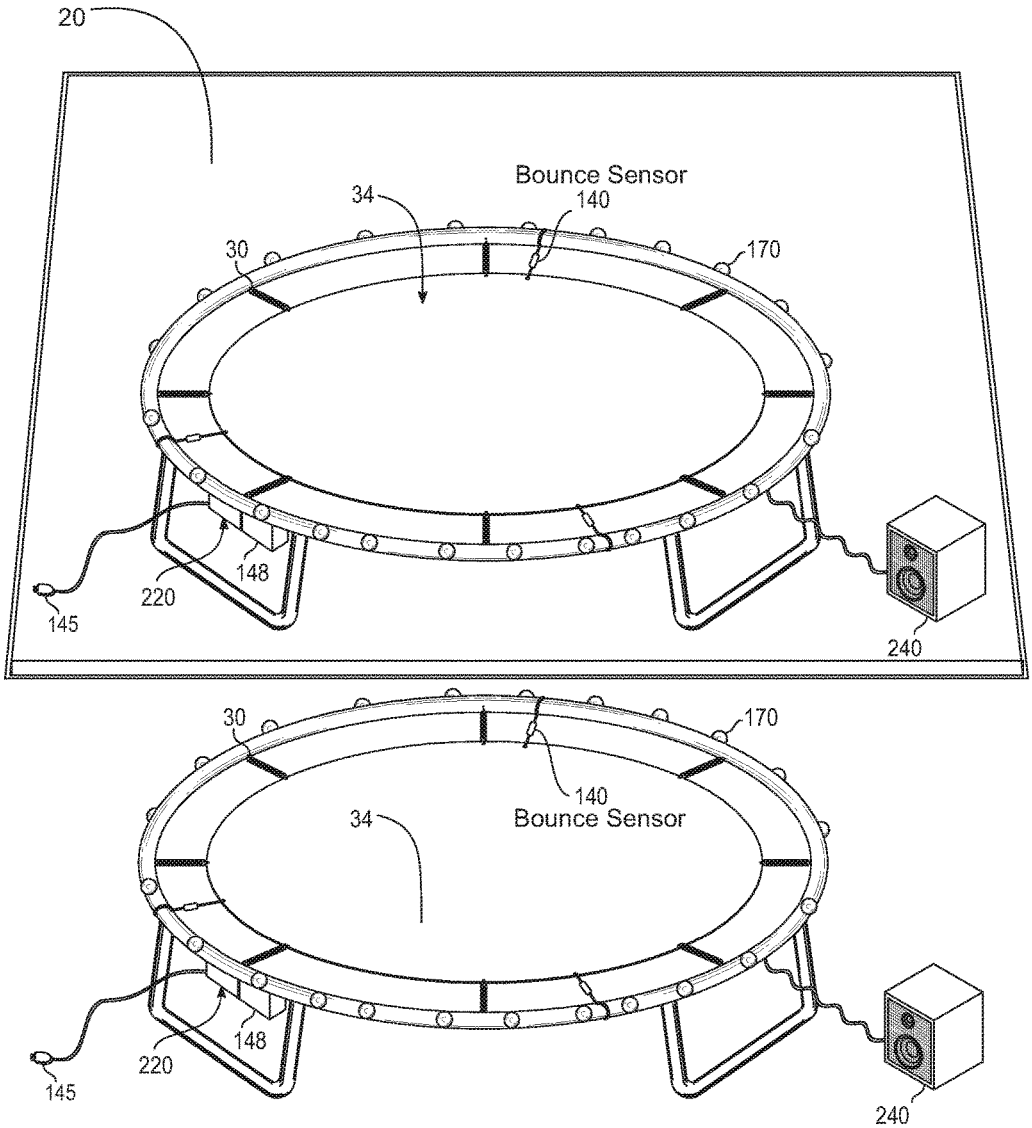
FIG. 3 is a diagram of the multiplayer trampoline game with the trampolines spaced apart from each other and in the shape of circular rings rather than rectangles.
Figure 4:
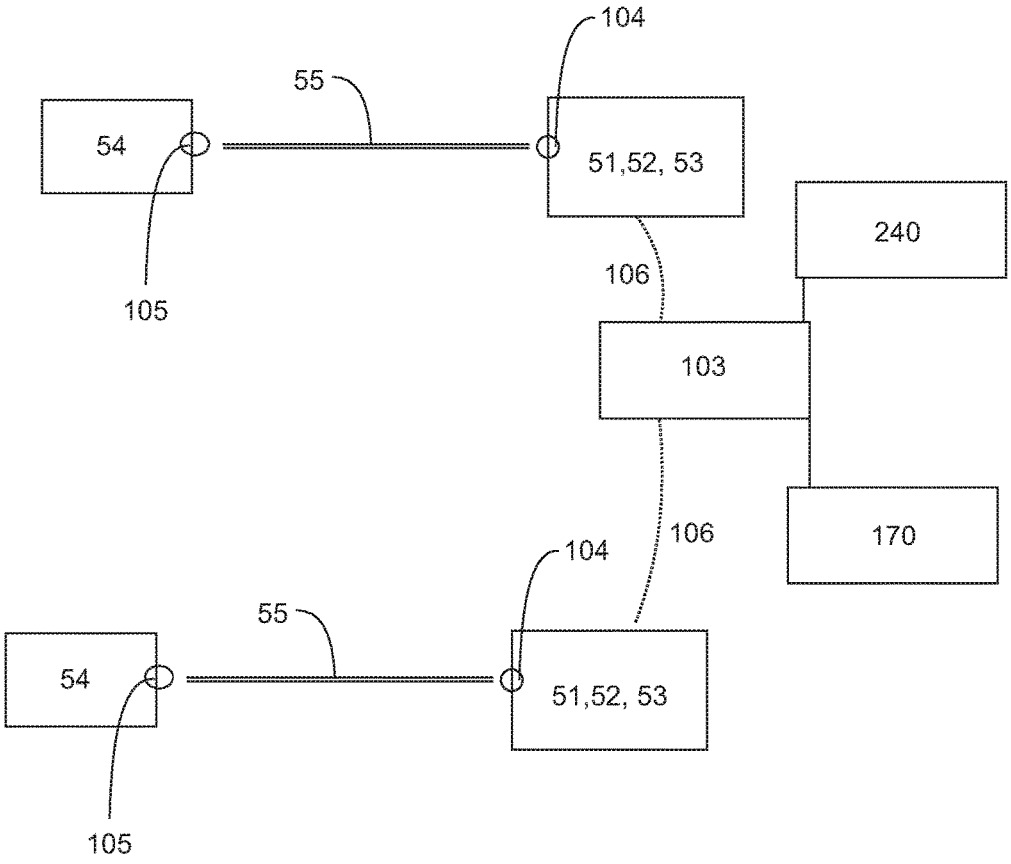
FIG. 4 is an electrical block diagram of the present invention.

FIG. 1 shows a partially assembled trampoline game. FIG. 2 shows a completely assembled trampoline game. The trampoline pad 31 can be a thin sheet or a thick spring cover, although a thick spring cover is preferred for absorbing shock. The trampoline pad 31 passes around the periphery of the bed border 33. The bed border 33 is a colored area or otherwise indicated area that shows an out of bounds area of play. The bed border 33 surrounds the bed play area 34.

The screen 20 has a non-permeable portion 23 which is preferably transparent for allowing users to see each other. A permeable portions 24 are mounted to the non-permeable portion 23 on the screen openings 27. The permeable portion 24 allows infrared beams to pass through the screen while the non-permeable portions 23 do not allow infrared beams to pass through the screen. Therefore, there are certain areas that a user can fire the infrared gun 54 through the screen. A screen opening 27 can be closed for structural integrity and safety by mounting a mesh or netting to the be stretched across the opening. The screen opening 27 will have a mesh and the mesh has openings that are not covered to allow airflow through the mesh openings.

The screen openings 27 have a permeable portion interface 28 where the permeable portions 24 are connected to the non-permeable portions 23. The permeable portion interface 28 is along the screen opening edge 29. The screen opening edge 29 defines the location of the permeable portion interface 28. The permeable portion interface 28 can be formed by heat laminating, adhesive, or more preferably by stitching a permeable portion 24 to the non-permeable portion 23. The permeable portion 24 could be made as a fine screen or mesh and the non-permeable portion could be made as a transparent plastic sheet having infrared and ultraviolet resistance.

When not in use, the flexible portion of the screen 20 is preferably rolled up or otherwise stowed for protection from the environment. Alternatively, portions of the non-permeable portions 23 can be made reflective so that a beam 55 emitted from an infrared gun 54 may bounce back and score against the same user.

The screen openings 27 can be arranged in a row such as a top row 52 above a bottom row 53. The top row can have four openings and the bottom row can have three openings for example. The top row of openings allows the user to jump high to shoot through one of the openings in the top row of openings. The lower row of openings allows the user to shoot through the lower row. Vertical movement by jumping improves dodging capability.

The players 50 have a headwear 53 such as a helmet. The headwear 53 can be configured as an infrared receiver for receiving a beam. Infrared receivers can also be mounted on the gun 54, a shirt or vest 52 and pants 51. The players preferably wear socks 56 to provide additional grip. Infrared receivers have become small enough to be able to attach to clothing such as shirts and pants. The infrared receivers are in communication with an electronic game controller. The electronic game controller can have a microprocessor such as a computer with a central processing unit for processing shots fired, and shots hit.

The enclosure 40 includes enclosure poles 41 that support and enclosure upper structure such as an enclosure upper ring 42. The first trampoline 101 and the second trampoline 102 could have the same enclosure upper ring 42 or independent separate ones. The enclosure upper ring 42 can connect to the screen frame 21 at an upper screen connection 26. The enclosure upper ring 42 suspends an enclosure netting 43 that drapes downwardly to connect to an inside edge of the trampoline pad 31 between the trampoline pad 31 and the bed border 33. The enclosure netting 43 can be connected to the bed border 33 using a rope or cord. The enclosure netting 43 can be double layer or single-layer. The enclosure netting 43 is preferably a large net that can enclose the pair of trampolines.

The enclosure 40 has vertically oriented enclosure poles 41 attached to the trampoline frame 30 such as at areas like the leg vertical portion 35. A pole connector 44 can connect the enclosure pole 41 to the leg vertical portion 35 at a pole connection area 45 formed on the leg vertical portion 35. The pole connection area 45 can have a bracket such as a pole connection bracket for receiving a lower end of the enclosure pole 41. The pole connection bracket can be a polymer member secured by a screw for absorbing shock.

Preferably the total height of the screen frame 21 is high enough to retain users within the bounding area. However, a screen frame 21 can have a height that is lower to allow users to shoot over the top of the screen as well.

Multiple trampolines can be added with screens between them to provide multiple user participation. A variety of different game rules can be implemented for multiple player battle competitions. For example, the gun 54 can have a sensor that deactivates the gun temporarily for a set amount of time if the sensor is hit by a beam 55 such as an infrared beam from an opposing player.

For each trampoline, a control system can be added for controlling the game. For example, each trampoline can have a control housing 148 that may contain a microprocessor for controlling game lights 170 and one are more game speakers 240. Preferably, a power supply 220 provides power via household electric current from a plug 145. A bounce sensor 140 can connect between the trampoline bed 34 and the trampoline frame 30. The control housing 148 can include a game controller formed as a microprocessor that wirelessly connects to the gun and/or target. The control housing 148 can be put into both trampolines including the first trampoline 101 and the second trampoline 102. The first and second trampoline can be spaced apart from each other with a gap and the screen can be placed on the ground.

Alternatively, the control system can be placed entirely on the gun. For example, the microprocessor is stored in the gun. The microprocessor may be mounted in the gun and receive wireless signals from the bounce sensor, and receive and send wireless signals to and from the targets to provide a wireless connection 106 that acts as a wireless connection bridge for registering hits with a CPU 103. The microprocessor can be formed as a central processing unit 103. The central processing unit can receive signals from a beam sensor 104. The beam sensor 104 can be mounted to the target such as the target vest, the target hat or the target pants. The beam sensor 104 can be electrically or wirelessly connected to the CPU 103.

At least a pair of beam emitter elements 105 can aim at and hit a pair of beam sensors 104. The beam sensors 104 are beam receivers. The game speakers 240 can emit a sound when the beam sensors 104 are activated by the beam emitter elements 105. The game speakers 240 can be large speakers that are box style speakers that rest on the ground. Alternatively, the game speakers 240 can be mounted to a game gun 54. A variety of the related art discussed in the discussion related art can be implemented on the trampoline game field to transform the game into a player versus player trampoline game as described in the present invention.

To encourage users to jump, the game gun 54 can have an ammunition count that increases or increments when users jump and the jump is sensed by the bounce sensor 140. The bounce sensor 140 can sense the vibration from the trampoline limited to one trampoline. When a user jumps, the user can receive one shot per jump, or one shot per two jumps for example. The time between each jump can have a minimum delay, or the amplitude of the vibration can have a high required value so as to require a high jump to reload the game gun 54. An ammunition capacity of five or ten can be implemented for encouraging users to take shots instead of storing up a large number of shots. A cool down between shots can increase the difficulty of tagging an opponent.

A wide variety of different rule changes can be processed by the CPU 103 for assisting in this trampoline game. Therefore, while the presently preferred form of the system has been shown and described, and several modifications thereof discussed, persons skilled in this art will readily appreciate that various additional changes and modifications may be made without departing from the spirit of the invention, as defined and differentiated by the following claims.

The invention claimed is:

1. A trampoline game comprising:

a. a first trampoline having a first trampoline frame and a first trampoline bed, wherein the first trampoline bed is tensioned across the first trampoline frame, wherein the first trampoline bed forms a first play area;

b. a first gun having a first beam emitter emitting a first beam signal, wherein the first beam signal is a radiant energy signal having infrared, ultraviolet or visible light;

c. a first target having one or more receivers for receiving a first beam signal from the first beam emitter of the first gun, wherein the first target is configured to be on a first player;

d. a second trampoline having a second trampoline frame and a second trampoline bed, wherein the second trampoline bed is tensioned across the second trampoline frame, wherein the second trampoline bed forms a second play area;

e. a second gun having a second beam emitter emitting a second beam signal, wherein the second beam signal is a radiant energy signal having infrared, ultraviolet or visible light;

f. a second target having one or more receivers for receiving a second beam signal from the second beam emitter of the second gun, wherein the second target is configured to be on a second player; and g. a screen separating the first play area from the second play area, wherein the first player is assigned the first play area and the second player is assigned the second play area, wherein the screen is configured to separate the first player from the second player.

2. The trampoline game of claim 1, further comprising: defined game parameters programmed into a microprocessor that receives data.

3. The trampoline game of claim 2, wherein said defined game parameters comprise: a boss target game parameter and underling target game parameters, wherein the boss target has greater hit points than underling targets.

4. The trampoline game of claim 2, wherein said defined game parameters comprise: a game level game parameter defined as a round requiring a complete deactivation of every target.

5. The trampoline game of claim 2, wherein said defined game parameters comprise: player attribute game parameters comprising: a gun cooldown time defined as a set delay time that the first and/or second gun requires before a successive shot is initiated.

6. The trampoline game of claim 2, wherein said defined game parameters comprise: player attribute game parameters comprising: a gun ammunition capacity defined as the number of shots that the gun stores such that when the gun ammunition reaches zero the first and/or second gun can no longer hit the targets.

7. The trampoline game of claim 3, wherein said defined game parameters comprise: player attribute game parameters comprising: player hit points defined as a certain number of hit points required to eliminate the player.

8. The trampoline game of claim 3, wherein said defined game parameters comprise: player attribute game parameters comprising: a charge per bounce defined as the number of bounces required to load a shot of ammunition to allow the first and/or second gun to fire a single shot, wherein the bounce sensor senses the bounces and sends bounce signals to the microprocessor, wherein the microprocessor increments the shot of ammunition.

9. The trampoline game of claim 3, further comprising: a hit point visual indicator located on the first and/or second target implemented by LED lighting.

10. The trampoline game of claim 1, further comprising: a bounce sensor for sensing the players bounces; wherein the bounce sensor outputs data; and further comprising: defined game parameters programmed into a microprocessor that receives said data.

11. The trampoline game of claim 10, wherein said defined game parameters comprise: a boss target game parameter and underling target game parameters, wherein the boss target has greater hit points than underling targets.

12. The trampoline game of claim 11, wherein said defined game parameters comprise: a game level game parameter defined as a round requiring a complete deactivation of every target.

13. The trampoline game of claim 11, wherein said defined game parameters comprise: a gun cooldown time defined as a set delay time that the first and/or second gun requires before a successive shot is initiated.

14. The trampoline game of claim 11, wherein said defined game parameters comprise: a gun ammunition capacity defined as the number of shots that the first and/or second gun stores such that when the gun ammunition reaches zero the first and/or second gun can no longer hit the targets.

15. The trampoline game of claim 11, wherein said defined game parameters comprise: player hit points defined as a certain number of hit points required to eliminate the player.

16. The trampoline game of claim 11, wherein said defined game parameters comprise: a charge per bounce defined as the number of bounces required to load a shot of ammunition to allow the first and/or second gun to fire a single shot, wherein the bounce sensor senses the bounces and sends bounce signals to the microprocessor, wherein the microprocessor increments the shot of ammunition.

17. The trampoline game of claim 11, further comprising: a hit point visual indicator located on the first and/or second target implemented by LED lighting.

18. The trampoline game of claim 1, further comprising: a bounce sensor for sensing the players bounces; wherein the bounce sensor outputs data.

* * * * *